US005725610A

United States Patent [19]

Vassilakis et al.

[11] Patent Number: 5,725,610

[45] Date of Patent: Mar. 10, 1998

[54] ADDITIVE COMPOSITION FOR COLD OPERABILITY OF MIDDLE DISTILLATES

[75] Inventors: Despina Vassilakis, Lyons; Robert Leger, Taluyers; Nathalie Cerqueda, Vienne, all of France; Wolfgang Ritter, Haan, Germany; Thomas Reichert, Meersbusch, Germany; Stephan von Tapavicza, Erkrath, Germany

[73] Assignees: Elf Antar France, Courbevoie, France; Henkel Kommanditgesellschaft Auf Aktien, Dusseldorf, Germany

[21] Appl. No.: 612,839

[22] PCT Filed: Sep. 29, 1994

[86] PCT No.: PCT/FR94/01138

§ 371 Date: Aug. 13, 1996

§ 102(e) Date: Aug. 13, 1996

[87] PCT Pub. No.: WO95/09220

PCT Pub. Date: Apr. 6, 1995

[30] Foreign Application Priority Data

Sep. 30, 1993 [FR] France ..... 93 11664

[51] Int. Cl.[6] ..... C10L 1/22

[52] U.S. Cl. ..... 44/331; 44/347; 44/386; 44/398; 44/554

[58] Field of Search ..... 44/330, 331, 347, 44/386, 398, 554

[56] References Cited

U.S. PATENT DOCUMENTS 4,153,423 5/1979 Wisotsky .
4,559,155 12/1985 Dorer, Jr. et al. .
4,564,460 1/1986 Dorer, Jr. et al. .
4,565,550 1/1986 Dorer, Jr. et al. .
4,575,526 3/1986 Dorer, Jr. et al. ..... 524/96
4,613,342 9/1986 Dorer, Jr. et al. .
4,623,684 11/1986 Dorer, Jr. et al. ..... 524/96
4,713,088 12/1987 Tack et al. .
4,810,260 3/1989 Tack et al. .
4,863,486 9/1989 Tack et al. .
4,976,746 12/1990 Denis et al. .

FOREIGN PATENT DOCUMENTS 2055418 5/1992 Canada .
1334013 1/1995 Canada .

*Primary Examiner*—Margaret Medley
*Attorney, Agent, or Firm*—Oblon, Spivak, McClelland, Maier & Neustadt, P.C.

[57] ABSTRACT

Additive composition enhancing the low temperature operability of average distillates beyond −20° C. comprising at least 40% by weight of a composition consisting of: i) from 60 to 94% by weight of an antisedimentation additive resulting from the reaction of at least one aliphatic dicarboxylic compound and one polyamine of general formula (II) wherein R is a saturated aliphatic radical comprising from 1 to 32 carbon atoms, n is 2–4 and m is 1–4; and ii) 6–40 % by weight of a dispersing-stabilizing additive having a molecular weight varying from 15000 to 50000 resulting from the esterification reaction of a linear alcohol having from 6 to 24 atoms with an organic acid such as maleic acid and its halides, the ester obtained being polymerized with itself or a copolymerizing compound selected from aliphatic dicarboxylic compounds.

22 Claims, No Drawings

ADDITIVE COMPOSITION FOR COLD OPERABILITY OF MIDDLE DISTILLATES

The present invention relates to a new additive composition which improves the cold operability of middle distillates to temperatures ranging beyond −20° C., and more particularly for diesel fuels and domestic fuel oils.

This cold operability corresponds to a limiting temperature at which middle distillates can be employed without any problem of blocking. It is intermediate between the cloud point temperature (AFNOR NFT 60105 or ASTMD 2500-66), characteristic of the onset of crystallization of waxes in the distillate and the flow point of the latter (AFNOR NFT 60105 or ASTMD 97-66).

It is well known that the crystallization of waxes is a factor limiting the use of middle distillates. It is also important to prepare diesel fuels adapted to the temperatures at which they will be employed in motor vehicles, that is to say to the surrounding climate. A cold operability of fuels at −10° C. is generally sufficient in many industrialized countries. However, in other countries, such as the Scandinavian countries, Canada and the countries of North Asia, fuel utilization temperatures well below −20° C. can be expected. The same applies in the case of domestic fuel oils stored outside for private houses and buildings.

This adaptation of the cold operability of diesel fuels is important, especially when engines are being started cold. If waxes have crystallized at the bottom of the fuel tank they can be drawn into the engine on starting and can block in particular the filters and prefilters arranged before the combustion chamber. Similarly in the case of the storage of domestic fuel oils, the waxes precipitate at the bottom of a tank and can be drawn in and can obstruct the conduits leading to the boiler. It is obvious that the presence of solids, such as wax crystals; prevents the normal circulation of the middle distillate.

To improve their circulation either in the engine or towards the boilers, a number of types of additives have come to light.

In a first step, the oil industry concentrated on the development of additives promoting the filterability of fuels at low temperature. The role of these additives, called CFPP (cold filter-plugging point) additives, is to limit the size of the wax crystals formed. Additives of this type, known very extensively to the person skilled in the art, are at present systematically added to middle distillates.

However, these additives, while controlling the size of the wax crystals, cannot prevent the sedimentation of the crystals formed, that is to say their agglomeration, especially in the fuel tank of diesel vehicles when standing or in storage tanks for domestic fuel oils.

Accordingly, in a second step, the oil industry made efforts to develop antisedimentation additives, that is to say dispersants, which keep the wax crystals in suspension in the middle dispersants, which prevents them from depositing and agglomerating together. The Applicant Company has developed especially such an additive described in French Patent Application FR-A-92 15358 of 17 Dec. 1992.

Nevertheless, the joint action of the CFPP and antisedimentation additives has not made it possible to improve the cold operability of all middle distillates produced in refining in the case of all the known crude oils.

This is why the oil industry has introduced a third type of additives with a view to lowering the cold operability temperature of middle distillates, whatever they be, beyond −20° C., even if their cloud point temperature is higher than −20° C.

The present invention is aimed at a new additive composition enabling the cold operability temperature of middle distillates to be lowered and maintained, even after storage, at temperatures beyond −20°C., including especially an additive of the third type which has the effect of maintaining a good dispersion of the wax crystals in the middle distillate.

The subject of the present invention is therefore and additive composition following the cold operability temperature of the distillates beyond −20° C., characterized in that it comprises at least 40% by weight of a combination of:

(i) 60% to 94% by weight of an antisedimentation additive of weight-average molecular mass of approximately 300 to 10,000, resulting from the reaction (a) of at least one aliphatic dicarboxylic compound chosen from the group consisting of maleic and alkylmaleic anhydrides, alkenylsuccinic anhydrides wherein alkenyl radical containing from 10 to 32 carbon atoms, dicarboxylic acids and alkyl diesters, (b) and of a polyamine containing a primary amine functional group, corresponding to the general formula

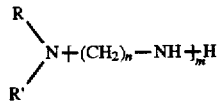

where R is a saturated aliphatic radical containing from 1 to 32 carbon atoms, R' is chosen from the group consisting of the hydrogen atom and saturated aliphatic radicals containing from 1 to 32 carbon atoms, n is an integer between 2 and 4 and m is an integer between 1 and 4, the said reaction taking place after dilution of the said dicarboxylic compound and of the said polyamine in a hydrocarbon solvent of boiling point of between 70° C. and 250° C. with a ratio of the molar concentrations of the said polyamine to the said dicarboxylic compound of between 0.3 and 0.8 and at a temperature of between 120° and 200° C., for 1 to 8 hours;

(ii) 6%–40% by weight of a stabilizing-dispersant additive for the wax crystals of weight-average molecular mass between 15,000 and 50,000, resulting (A) from at least one stage of esterification of a saturated linear alcohol containing from 6 to 24 carbon atoms with an organic acid included in the group consisting of acrylic acid and its halides and (B) from at least one stage of polymerization of the ester resulting from the esterification with itself or with at least one copolymerizing compound chosen from the dicarboxylic compounds of the group consisting of maleic, alkylmaleic and alkenylsuccinic anhydrides, acrylic acid, fumaric acid and the esters of these acids.

The polymer thus obtained containing more than 20% by weight of alkyl chains containing 12 and 14 carbon atoms and finally more than 10% by weight and preferably more than 20% by weight of alkyl chains containing 16 and more carbon atoms.

The composition of the present invention improves the cold operability of middle distallates, since it makes it possible to attain and maintain utilization temperatures down to −20° C. without the circulation of the middle distillate being affected by solidifications of wax crystals owing to agglomeration promoting blockages.

More precisely, the new composition makes it possible to limit the sedimentation of the wax crystals and contributes to maintaining the dispersion of the wax crystals in middle distillates down to −20° C.

These advantages stem from a completely unexpected synergy effect observed by the Applicant Company, due to the combination of the antisedimentation additive (i) with the stabilizing-dispersant additive for the wax crystals according to the invention (ii).

In a first embodiment of the invention the polyamine chosen for preparing the antisedimentation additive corresponds to the following general formula (I)

$$R-NH-[-(CH_2)_n-NH-]_m-H \quad (I)$$

in which R is a saturated aliphatic radical containing from 12 to 32 carbon atoms, n is an integer between 2 and 4 and m is an integer between 1 and 4.

In a second embodiment of the invention the polyamine chosen for preparing the antisedimentation additive corresponds to the following general formula (II)

$$\begin{array}{l} R \\ \quad\diagdown \\ \quad\quad N+(CH_2)_n-NH+_m H \\ \quad\diagup \\ R' \end{array} \quad (II)$$

in which R and R' are identical or different linear alkyl radicals containing from 1 to 24 carbon atoms, n is an integer between 2 and 4 and m is an integer between 1 and 4.

The dicarboxylic compound employed for manufacturing the antisedimentation additive is preferably chosen from the group consisting of maleic and alkylmaleic anhydride, especially methylmaleic anhydride, and the alkenylsuccinic anhydrides obtained by the reaction of at least one olefin containing from 10 to 32 carbon atoms with maleic anhydride.

n-Octadecenylsuccinic and dodecenylsuccinic anhydrides will be preferred as dicarboxylic compound.

According to the invention the stabilizing-dispersant additive is obtained from at least two reactions, an esterification reaction followed by a polymerization reaction.

The saturated linear alcohol taking part in the esterification reaction for the formation of this additive consists of an alkyl chain containing from 8 to 22 carbon atoms.

The preferred organic acid involved in the esterification reaction (A) is acrylic acid.

According to the invention the stabilizing-dispersant additive is therefore a polymer of general formula (III):

$$R_1+(CH_2)_p-\underset{\underset{\underset{\underset{R_2}{|}}{O}}{\underset{|}{C=O}}}{\underset{|}{CH}}+_q R_3 \quad (III)$$

in which $R_1$ and $R_2$ are identical or different and correspond to the hydrogen atom or a saturated aliphatic radical containing from 1 to 30 carbon atoms, $R_3$ corresponds to a hydrogen atom or a dicarboxylic compound chosen from the group consisting of maleic, alkylmaleic or alkenylsuccinic anhydrides, acrylic acid and fumaric acid, p is an integer between 1 and 100 and q is an integer between 1 and 10.

In a first preferred embodiment of the invention the stabilizing-dispersant additive is a polyacrylate of general formula (IV)

$$H-(CH_2-\underset{\underset{\underset{\underset{R_2}{|}}{O}}{\underset{|}{C=O}}}{\underset{|}{CH}})_q-H \quad (IV)$$

in which $R_2$ is a saturated aliphatic radical containing from 8 to 22 carbon atoms and where q is an integer between 1 and 50.

In a second preferred embodiment of the invention the stabilizing-dispersant additive is a copolymer.

90 to 99% by weight of the said copolymer consists of at least one alkyl acrylate containing from 8 to 22 carbon atoms and preferably from 8 to 18 carbon atoms per alkyl chain, and from 10 to 1% by weight of at least one copolymerizing compound. In a particular embodiment of the invention 95 to 99% by weight of this said copolymer consists of at least one alkyl acrylate and 1 to 5% by weight of at least one copolymerizing compound.

The said copolymerizing compound is a dicarboxylic compound chosen from the group consisting of maleic, alkylmaleic and alkenylsuccinic anhydrides and fumaric acid. The preferred copolymerizing compounds are maleic anhydride and fumaric acid.

The new composition according to the present invention advantageously includes a filterability additive. In this case 40 to 70% by weight of it consists of the combination of at least one antisedimentation additive and of at least one stabilizing-dispersant additive according to the invention and 30 to 60% by weight of at least one filterability additive. It preferably includes from 65 to 50% by weight of the said combination and from 35 to 50% by weight of the filterability additive. The preferred filterability additive is chosen from the group consisting of ethylene-vinyl acetate (EVA) copolymers and ethylene-vinyl propionate (EVP) copolymers.

Another subject of the invention is a crude oil middle distillate composition including a major proportion of crude oil middle distillate and a minor proportion of the said additive composition, the first subject of the invention.

In the said middle distillate composition the said middle distillate is a hydrocarbon cut distilled between 150° and 450° C., and preferably a diesel fuel cut distilled between 190° and 350° C.

In the preferred embodiment of the distillate composition the minor proportion of the said additive composition, the first subject of the invention, is between 0.01 and 0.20% by weight of the said middle distillate composition.

Examples are given without any limitation being implied, for the purpose of illustrating the advantages of the present invention.

EXAMPLE 1

This example is aimed at emphasizing the unexpected synergy effect of the stabilizing-dispersant additive and of the antisedimentation additive in the presence of an FLT-type filterability additive.

Samples of diesel fuels have been prepared for this purpose from a diesel fuel as defined below and in Table I.

% paraffin: 11.84% relative density at 15° C.: 0.836

TABLE I

| ASTM D86 distillation (°C.) | |
|---|---|
| I.p. | 159 |
| 5% | 184 |
| 10% | 191 |
| 20% | 204 |
| 30% | 219 |
| 40% | 235 |
| 50% | 254 |
| 60% | 275 |
| 70% | 297 |

TABLE I-continued

| ASTM D86 distillation (°C.) | |
|---|---|
| 80% | 318 |
| 90% | 340 |
| 95% | 355 |
| F.P. | 363 |

I.P.: initial point
F.P.: final point

These diesel fuels include different combinations of additives, as described in Table II below:

TABLE II

| DIESEL FUEL ADDITIVE | COMPOSITION |
|---|---|
| 1 | 0.06% of the filterability additive (FLT) in the diesel fuel |
| 2 | 0.06% additive composition in the diesel fuel<br>*40% of filterability additives (FLT)<br>*60% of antisedimentation additive |
| 3 | 0.06% additive composition in the diesel fuel<br>*40% filterability additive (FLT)<br>*60% stabilizing dispersant additive |
| 4 | 0.06% additive composition<br>*40% filterability additive (FLT)<br>*36% antisedimentation additive<br>*24% stabilizing dispersant additive |

filterability additive: K5486 marketed by BASF
antisedimentation additive: CP9555 marketed by Elf Antar France
stabilizing-dispersant additive according to the invention.

These four diesel fuels containing additives are packaged in four 250-$cm^3$ test tubes.

These test tubes are stoppered hermetically and left to rest in a cold chamber at (−20° C.) for 24 h. After 24 hours the homogeneity of the diesel fuel containing additives is evaluated using the number of phases observed in each test tube and their quality, and then the cloud point temperature of the upper and lower phases is measured.

The quality of the upper phase is decisive with regard to the antisedimentation effectiveness of the additive composition. When the upper phase is cloudy a high proportion of waxes has remained in suspension. When this phase is clear virtually all the wax has settled, that is to say has agglomerated at the bottom of the test tube.

The quantitative results obtained from the % by volume of these different phases and the difference in the cloud point temperature between the upper phase and the lower phase in the test tube are collated in Table III below:

TABLE III

| Test tube | Number of phases | Settled phase % vol. | Cloudy phase % vol. | Slightly cloudy phase % vol. | Limpid or clear phase % vol. | Difference in cloud point temperature °C. |
|---|---|---|---|---|---|---|
| 1 | 2 | 22 | | | 78 | −19 |
| 2 | 2 | 9 | | 91 | | −13 |
| 3 | 2 | 23 | | | 77 | −21 |
| 4 | 2 | 4 | 96 | | | −4 |

It is found that when an antisedimentation additive is added to the diesel fuel to which the FLT has already been added (samples 1 and 2), the homogeneity of the diesel fuel is improved, which is reflected in a decrease in the difference in cloud point between the upper phase and the lower phase in the test tube.

When the stabilizing-dispersant additive according to the invention is added to the filterability (FLT) additive alone in the diesel fuel, the homogeneity of the diesel fuel is not improved and the differences in cloud point between the lower and upper phases remain identical (samples 1 and 3).

On the other hand, the combination of the antisedimentation additive and of the stabilizing-dispersant additive with the FLT additive greatly improves the homogeneity of the diesel fuel and limits the difference in the cloud points between the upper and lower phase (samples 1, 2 and 4).

This emphasizes the superiority of the invention, due essentially to the synergy effect between the antisedimentation additive and the stabilizing-dispersant additive.

EXAMPLE II

This example is aimed to show the universality of the additive combination according to the invention with a view to lowering the cold operability of middle distillates beyond −20° C., whatever their origin.

For the purposes of this example three diesel fuels A, B and C, to which combinations according to the invention have been added, are tested as described in Example I. They are characterized by their paraffin distribution, that is to say their concentration of paraffins containing fewer than 13 carbon atoms ($<C_{13}$), paraffins containing from 13 to 18 carbon atoms ($C_{13}$–$C_{18}$) and paraffins containing from 19 to 23 carbon atoms ($C_{19}$–$C_{23}$). This distribution is characteristic of the behavior of diesel fuels when cold, whatever their origin.

The paraffin distributions for these three diesel fuels are given in Table IV below:

TABLE IV

| Diesel fuel | % paraffins in the diesel fuel | % $<C_{13}$ paraffins | % C $<C_{13}$–$C_{18}$ paraffins | % $C_{19-23}$ paraffins |
|---|---|---|---|---|
| A | 10.1 | 4.95 | 71.29 | 23.76 |
| B | 10.0 | 17 | 74 | 9 |
| C | 11.84 | 20.87 | 50.22 | 18.91 |

0.06% by weight of an appropriate additive composition according to the invention is added to each of these three diesel fuels, these compositions being described in Table V below:

TABLE V

| Diesel fuel composition | % filtration additive* | % antisedimentation additive* | % stabilizing dispersant additive* |
|---|---|---|---|
| A | 40 | 36 | 24 |
| B | 25 | 65 | 10 |
| C | 35 | 55 | 10 |

*These additives are described in Example I.

The results of the test for behavior when cold as described in Example I are given for these three diesel fuels containing additives according to the invention in Table VI below, in comparison with these same three diesel fuels to which only 0.025% by weight of the filterability (FLT) additive has been added:

TABLE VI

| Diesel fuel | Number of phases | Settled phase % vol. | Cloudy phase % vol. | Limpid or clear phase % vol. | Difference in cloud point temperature |
|---|---|---|---|---|---|
| A + FLT | 2 | 12 | | 88 | −22 |
| A + additive* | 2 | 18 | 82 | | −7 |
| B + FLT | 2 | 20 | | 80 | −20.1 |
| B + additive* | 2 | 2 | 98 | | −3 |
| C + FLT | 2 | 24 | | 76 | −21.8 |
| C + additive* | 2 | 4 | 96 | | −4 |

+ additive*: according to the invention.

It is found that, whatever the paraffin distribution of these diesel fuels, the compositions according to the invention promote the cold operability at −20° C. characterized by two phases being obtained, a settled phase and a cloudy phase, and a difference in temperature between the cloud points of the cloudy upper phase and of the settled lower phase of between 0 and 10 in absolute value.

We claim:

1. Additive composition comprising a combination of (i) and (ii), as follows:

(i) 60% to 94% by weight of an antisedimentation additive of weight-average molecular mass of approximately 300 to 10,000, resulting from the reaction (a) of at least one aliphatic compound selected from the group consisting of maleic and alkylmaleic anhydrides, alkenylsuccinic anhydrides wherein alkenyl radical contains from 10 to 32 carbon atoms, dicarboxylic acids and alkyl diesters thereof, (b) and of a polyamine containing a primary amine functional group, corresponding to the general formula

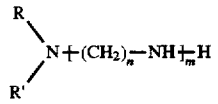

where R is a saturated aliphatic radical containing from 1 to 32 carbon atoms, R' is selected from the group consisting of the hydrogen atom and saturated aliphatic radicals containing from 1 to 32 carbon atoms, n is an integer between 2 and 4 and m is an integer between 1 and 4, the said reaction taking place after dilution of the said aliphatic compound and of the said polyamine in a hydrocarbon solvent of boiling point of between 70° C. and 250° C. with a ratio of the molar concentrations of the said polyamine to the said aliphatic compound of between 0.3 and 0.8 and at a temperature of between 120° and 200° C. and (ii) 6% to 40% by weight of a stabilizing-dispersant additive of weight-average molecular mass between 15,000 and 50,000, resulting from the reaction of (A) from at least one stage of esterification of a saturated linear alcohol containing from 6 to 24 carbon atoms with a compound selected from the group consisting of acrylic acid and its halides (B) and from at least one stage of polymerization of the ester obtained at the previous esterification stage with itself or with a copolymerizing compound selected from the group consisting of maleic, alkylmaleic and alkenylsuccinic anhydrides, acrylic acid, fumaric acid and the esters of these acids, to form a polymer, the polymer thus obtained containing more than 20% by weight of alkyl chains containing 12 and 14 carbon atoms and more than 10% by weight of alkyl chains containing 16 and more carbon atoms.

2. Composition according to claim 1, characterized in that the polyamine selected for preparing the said antisedimentation additive corresponds to the general formula $$R—NH—[—(CH_2)_n—NH—]_m—H \quad (I)$$

in which R is a saturated aliphatic radical containing from 12 to 32 carbon atoms, n is an integer between 2 and 4 and m is an integer between 1 and 4.

3. Composition according to claim 1, characterized in that the polyamine chosen for preparing the said antisedimentation additive corresponds to the general formula

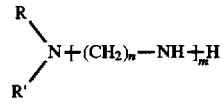

(II)

in which R and R' are identical or different linear alkyl radicals containing from 1 to 24 carbon atoms, n is an integer between 2 and 4 and m is an integer between 1 and 4.

4. Composition according to claim 1, characterized in that the aliphatic compound selected for preparing the said antisedimentation additive is selected from the group consisting of maleic and alkyl-maleic anhydrides, and the alkenylsuccinic anhydrides obtained by reaction of at least one olefin containing from 10 to 32 carbon atoms with maleic anhydride.

5. Composition according to claim 4, characterized in that the aliphatic compound is n-octadecenylsuccinic anhydride or dodecenylsuccinic anhydride.

6. Composition according to claim 1, characterized in that the saturated linear alcohol taking part in the esterification reaction consists of an alkyl chain containing from 8 to 22 carbon atoms.

7. Composition according to claim 1, characterized in that the organic acid involved in the said esterification reaction (A) is acrylic acid.

8. Composition according to claim 1, characterized in that the stabilizing-dispersant additive is a polymer of general formula

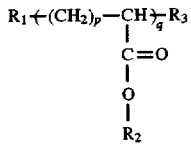

(III)

in which $R_1$ and $R_2$ are identical or different and correspond to a hydrogen atom or a saturated aliphatic radical containing from 1 to 30 carbon atoms, $R_3$ corresponds to a hydrogen atom or is selected from the group consisting of maleic, alkylmaleic and alkenyl-succinic anhydrides, acrylic acid and fumaric acid, p is an integer between 1 and 100 and q is an integer between 1 and 10.

9. Composition according to claim 1, characterized in that the stabilizing-dispersant additive is a polyalkyl acrylate of general formula

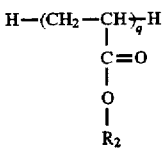

(IV)

in which $R_2$ is a saturated aliphatic radical containing from 8 to 22 carbon atoms and where q is an integer between 1 and 50.

10. Composition according to claim 1, characterized in that the stabilizing-dispersant additive is a copolymer.

11. Composition according to claim 10, characterized in that 90 to 99% by weight of the copolymer consists of at least one alkyl acrylate containing from 8 to 22 carbon atoms per alkyl chain and from 10 to 1% by weight of at least one copolymerizing compound.

12. Composition according to claim 10, characterized in that 95 to 99% of the copolymer consists of at least one alkyl acrylate containing from 8 to 22 carbon atoms per alkyl chain and 1 to 5% of at least one copolymerizing compound selected from the group consisting of maleic, alkylmaleic and alkenylsuccinic anhydrides and fumaric acid.

13. Composition according to claim 10, characterized in that the alkyl acrylate units contain from 8 to 18 carbon atoms per alkyl chain.

14. Composition according to claim 10, characterized in that the copolymerizing compound is maleic anhydride or fumaric acid.

15. Composition comprising from 40 to 70% by weight of the said combination of antisedimentation additive and of a stabilizing-dispersant additive of claim 1, and from 30 to 60% by weight of a filterability additive chosen from the group consisting of ethylene-vinyl acetate copolymers and ethylene-vinyl propionate copolymers.

16. Composition according to claim 15, comprising from 65 to 50% by weight of the said combination and from 35 to 50% by weight of the said filterability additive.

17. Crude oil middle distillate composition including a major proportion of crude oil middle distillate and a minor proportion of an additive composition according to claim 1.

18. Crude oil middle distillate composition according to claim 17, characterized in that the said middle distillate is a hydrocarbon cut distilling between 150° and 450° C.

19. Crude oil middle distillate composition according to claim 17, characterized in that the minor proportion of the said additive composition corresponds to 0.01 to 0.20% by weight of the said middle distillate composition.

20. Composition according to claim 1, wherein said polymer contains more than 20% by weight of alkyl chains containing 16 and more carbon atoms.

21. Composition according to claim 4, wherein the aliphatic compound is methylmaleic anhydride.

22. Crude oil middle distillate composition according to claim 17, characterized in that the said middle distillate is a diesel fuel cut distilling in a temperature range between 190° and 350° C.

* * * * *